US005337646A

United States Patent [19]

Austin

[11] Patent Number: 5,337,646

[45] Date of Patent: Aug. 16, 1994

[54] DEVICE AND SYSTEM FOR SUPPORTING DRUMS AND OTHER PERCUSSION MUSICAL INSTRUMENTS

[76] Inventor: Irving G. Austin, 24992 Nellie Gail, Laguna Hills, Calif. 92653

[21] Appl. No.: 5,888

[22] Filed: Jan. 15, 1993

[51] Int. Cl.[5] ..... G10D 13/02

[52] U.S. Cl. ..... 84/421; 248/184

[58] Field of Search ..... 84/421, 453; 248/184, 248/185

[56] References Cited

U.S. PATENT DOCUMENTS

| | | | |
|---|---|---|---|
| 292,218 | 10/1987 | Corder | D17/22 |
| 3,945,291 | 3/1976 | Zickos | 84/421 |
| 4,441,398 | 4/1984 | Baker | 84/421 |
| 4,479,414 | 10/1984 | Willis | 84/421 |

*Primary Examiner*—Michael L. Gellner
*Assistant Examiner*—Cassandra C. Spyrou
*Attorney, Agent, or Firm*—Stetina and Brunda

[57] ABSTRACT

A device and system for mounting and supporting drums, percussion instruments and other apparatus (e.g., microphones) during musical performances. The device generally comprises a rack upon which drums, instruments and other apparatus may be mounted. The rack may incorporate first and second parallel bar members disposed in a horizontal plane such that the drums, percussion instruments and other apparatus may be mounted concommitantly to said first and second parallel bar members. The rack may also incorporate means for attaching said rack to the top of a bass drum such that the bass drum will act as a vertical support leg to support at least a portion of the rack a fixed distance above an underlying floor. Attachment brackets are mountable on the rack devices of the present invention to facilitate attachment of drums, instruments and/or apparatus thereto. There is also provided a drummer's seat connectable to a rack device, such as the rack devices of the present invention, to minimize movement of the rack device and/or bass drum during performance.

14 Claims, 4 Drawing Sheets

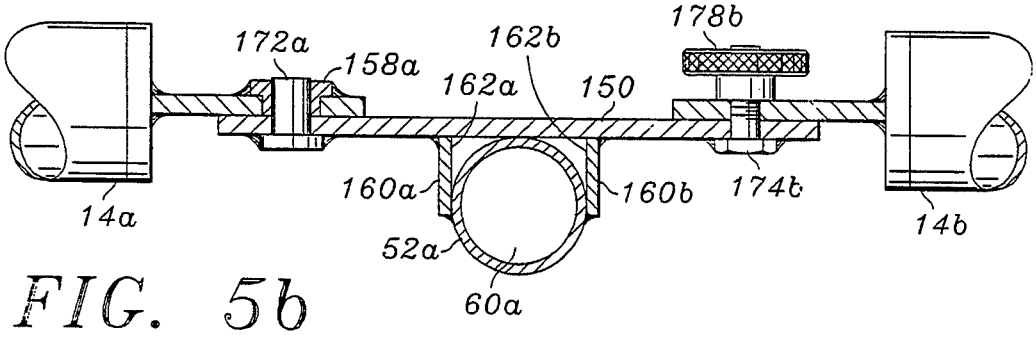
FIG. 5b
FIG. 9
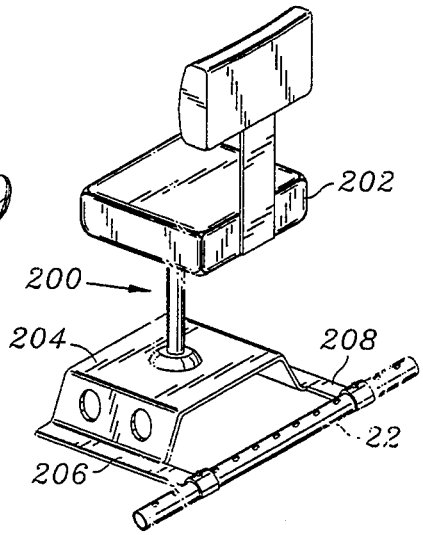
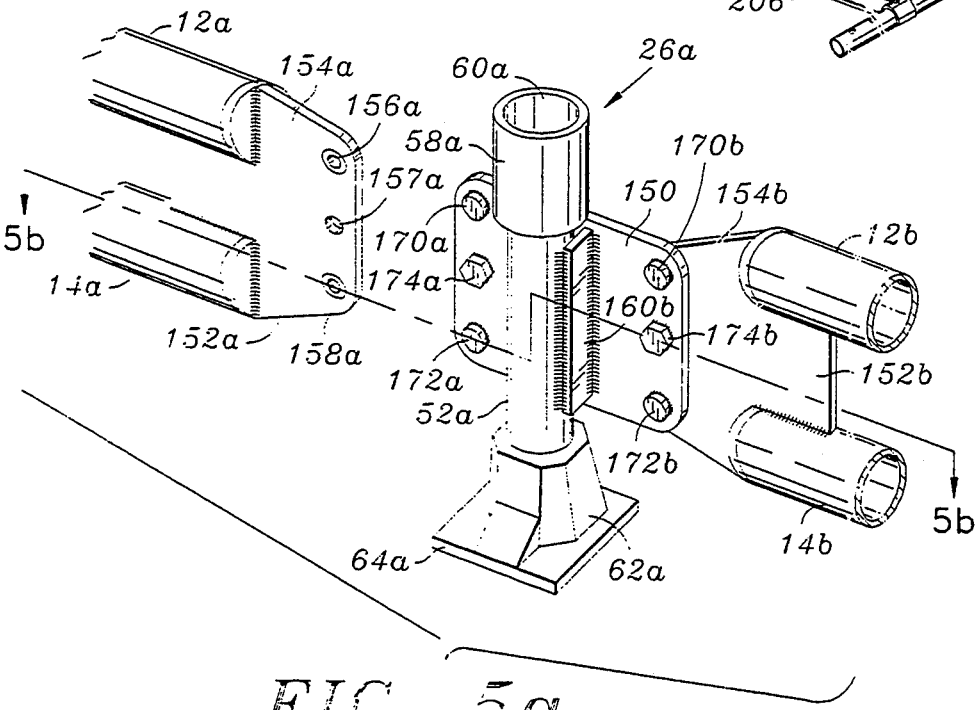
FIG. 5a

DEVICE AND SYSTEM FOR SUPPORTING DRUMS AND OTHER PERCUSSION MUSICAL INSTRUMENTS

BACKGROUND OF THE INVENTION

The present invention relates generally to devices for positioning and holding musical instruments and, more particularly, to a support rack and system for holding a plurality of percussion instruments, such as drums.

BACKGROUND OF THE INVENTION

Drum sets utilized in musical performance typically comprise a plurality of different sizes and types of drums and other percussion instruments (e.g., cymbals, pads, cow bells, guiro, etc.) positioned about a central point such that each is accessible to the drummer who is typically seated on a stool.

Each drum set typically incorporates a relatively large bass drum. The bass drum is generally positioned in front of the drum set and is provided with a foot pedal whereby the drummer may utilize his/her foot to effect percussion of the bass drum. The remaining drums of the drum set are then mounted on top of, and/or on either side of the bass drum and/or positioned on either side of the centrally-positioned bass drum.

In some drum sets of the prior art, each separate drum or percussion instrument is :supported by a separate stand having a plurality of feet or tripod-like structure. The utilization of such individual stands or holders for each drum, or instrument, can result in a rather crowded, cluttered appearance due to the confined area in which such stand or holders are positioned. In an effort to eliminate the crowding and clutter created by the use of individual stands or holders for each drum instrument, some drummers have undertaken to utilize a unitary drum rack whereby each individual drum or percussion instrument is mounted upon a unitary rack-like structure. Examples of commercially available drum racks include Gibraltar Racks (Kaman Music Corp., P.O. Box 507, Bloomfield, Conn. 06002) and the Collarlock Bar System (Drum Workshop, Inc., 101 Bernoulli Circle, Dept. H, Oxnard, Calif. 93030).

Although the prior art has included a number of drum racks, there remains a need in the art for improved drum mounting racks whereby individual drums and/or percussion instruments may be firmly held in convenient positions, with minimal cross vibration and optimal musical or acoustical qualities of the sound produced thereby.

SUMMARY OF THE INVENTION

The present invention comprises a device for mounting drums, percussion instruments (e.g., cymbals, cow bells, pads, guiro, etc. . . . ), or other apparatus (e.g., microphones), in desired positions so as to be readily accessible to and useable by a drummer during a musical performance.

In accordance with the invention, there is provided a rack for supporting drums, percussion instruments or other apparatus, said device comprising at least one horizontal rail member having first and second ends. Vertical leg members extend downwardly from the first and second ends of said horizontal rail member and a bass drum attachment apparatus is positioned on said horizontal rail member, between the first and second ends thereof. Said bass drum attachment apparatus is connectable on top of an under-positioned bass drum such that said bass drum will combine with said vertical leg members to support said at least one rail member in a substantially horizontal plane a fixed distance above an underlying floor.

Further in accordance with the invention, there is provided a rack device for holding and supporting drums, percussion instruments and other apparatus said rack device having a first rail member and a second rail member disposed, parallel to one another, in a generally horizontal plane. Various drums, instruments, and/or other apparatus are concommitantly attachable to both said first and second rail members by way of any appropriate mounting bracket(s) or clamping means.

Still further in accordance with the present invention, there are provided specific mounting brackets for mounting drums, percussion instruments or other apparatus to a drum rack, such as the rack device of the present invention, having first and second parallel horizontal rail members. The mounting brackets of the present invention may incorporate vibration damping or padding material to minimize cross-transmission of vibrational energy among the various drums, instruments and/or apparatus mounted on the rack device of the present invention.

Still further in accordance with the present invention, there is provided a drummer's seat, such as a stool, having connector members, brackets or other linkages for connecting said drummer's seat to a drum rack, such as the drum rack of the present invention. The interconnection between the drummer's seat and the drum rack serves to minimize or deter movement of the drum rack and/or bass drum during operation.

Further objects and advantages of the invention will become apparent to those skilled in the art upon reading and understanding of the following detailed description and the accompanying drawings.

BRIEF DESCRIPTION OF THE DRAWINGS

FIG. 5A is a partially exploded perspective view of a portion of a drum support device of the present invention incorporating an alternative bass drum mounting fixture.

FIG. 5B is a staggered cross-sectional view through line 5B—5B of FIG. 5A.

FIG. 9 is a perspective view of a drummer's seat of the present invention incorporating linking members whereby said drummer's seat may be connected to a drum rack, such as the drum rack of the present invention.

DETAILED DESCRIPTION OF A PREFERRED EMBODIMENT

The following description and the accompanying drawings are provided for purposes of describing and illustrating a presently preferred embodiment of the invention only. The following description and accompanying drawings are not intended to limit the scope of the claims in any way.

Figure 1:
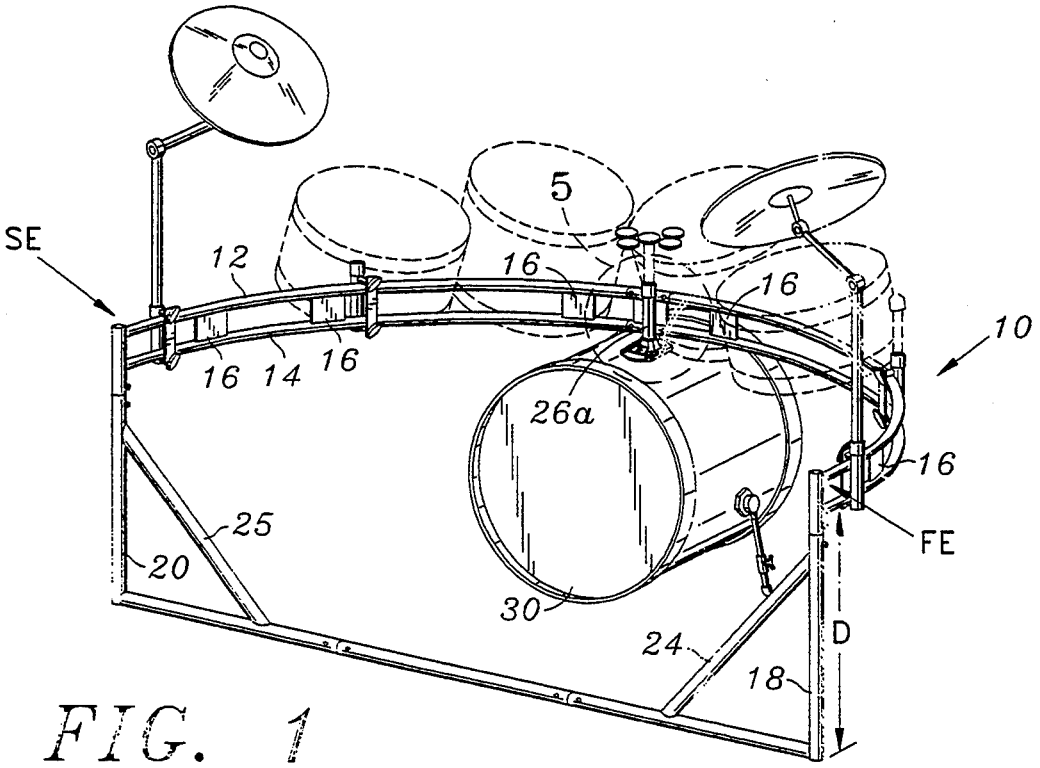
FIG. 1 is a rear perspective view of a drum support system of the present invention having a plurality of drums and percussion instruments mounted thereon.
Figure 2:
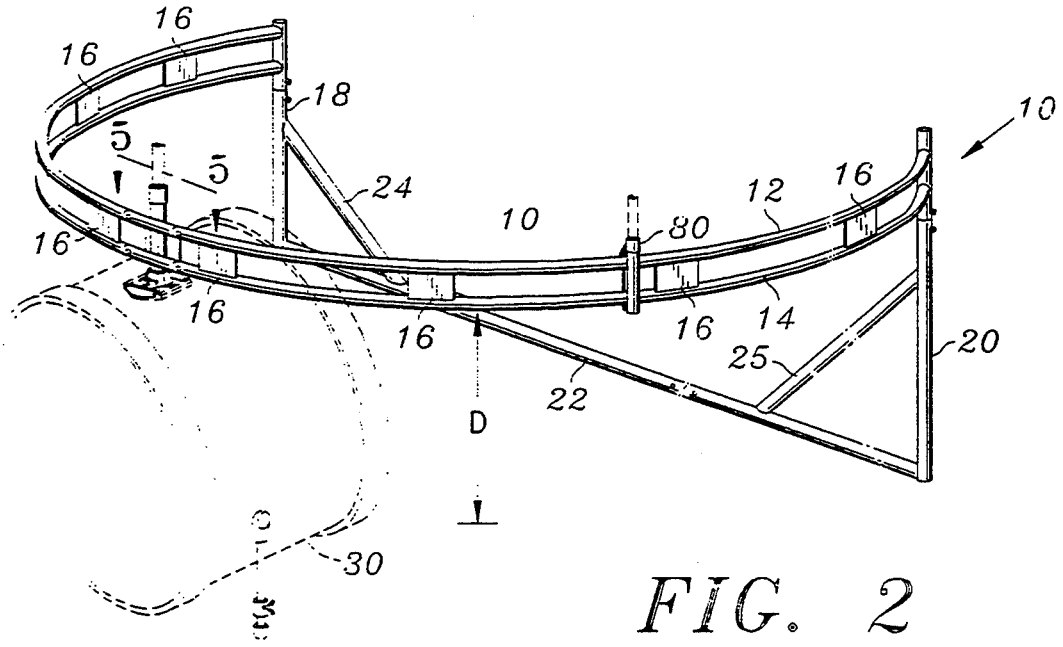
FIG. 2 is a front perspective view of a drum support system of the present invention.
Figure 3:
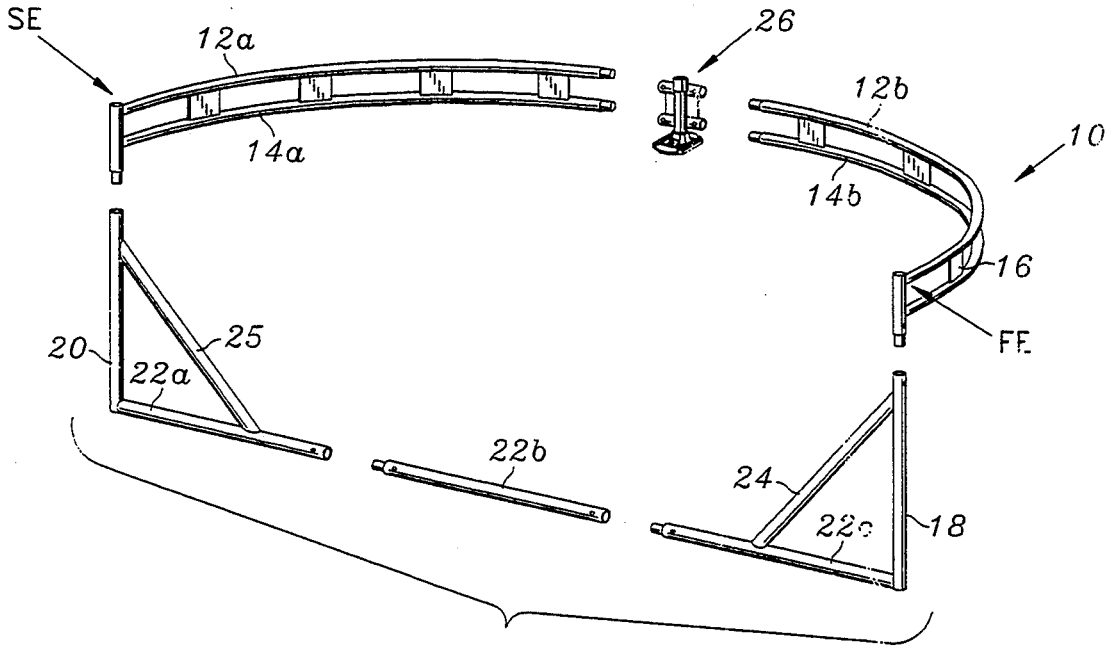
FIG. 3 is an exploded rear perspective view of a drum rack device of the present invention.

FIGS. 1-3 show a presently preferred embodiment of a drum support rack device of the present invention.

The device 10 comprises a first bar or rail member 12 and a second bar or rail member 14 positioned parallel to one another and disposed in a generally horizontal plane a spaced distance D above an underlying support surface or floor. A plurality of linking members 16 are affixed to and traverse between the first bar member 12 and second bar member 14 to hold the first bar member 12 and second bar member 14 in fixed parallel-spaced relation to one another. Linking members 16 are also configured and positioned to prevent torsional movement of the first and second bar members 14, 16 relative to one another.

In the embodiment shown, the first and second bar members 12, 14 are of generally arcuate configuration having coterminal first ends FE and coterminal second ends SE.

The first ends FE of the first and second bar members 12, 14 are affixed adjacent the upper end of first vertical support member 18. The second ends SE of the first and second bar members 12, 14 are affixed adjacent the upper end of second vertical support member 20.

The bottom ends of the first and second vertical support members 18, 20 are attached to the corresponding ends of a basal cross-member 22. The basal cross-member 22 is traverses between the vertical support members 18, 20 and is substantially perpendicular thereto.

A first diagonal brace member 24 is attached to and extends between the first vertical support member 18 and the basal cross member 22. Similarly, a second diagonal brace member 25 is attached to and extends between the second vertical support member 20 and the basal cross-member 22.

Figure 5:
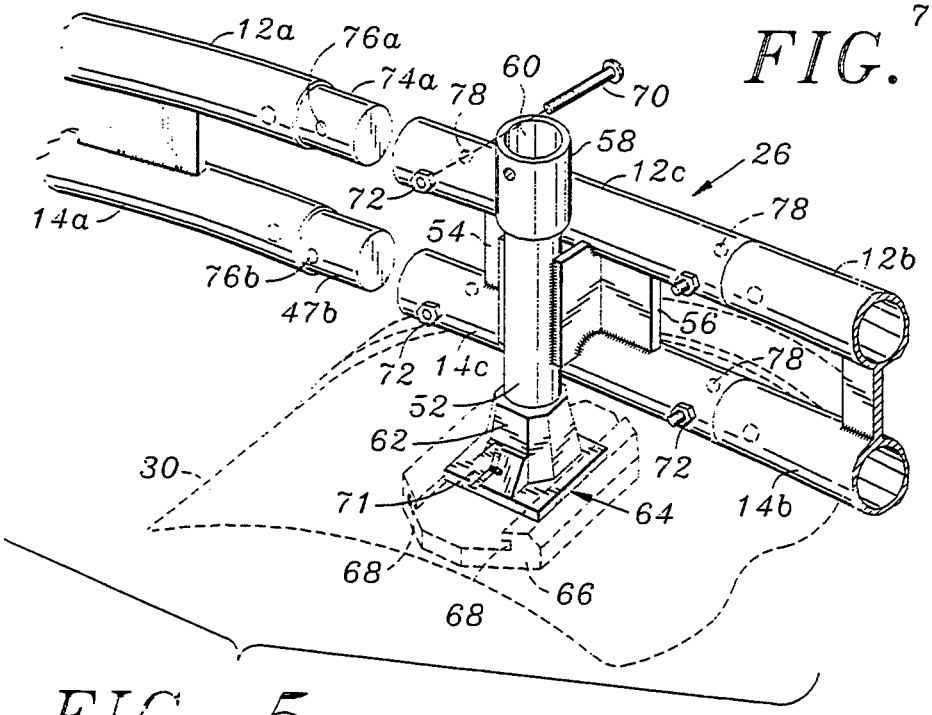
FIG. 5 is an enlarged perspective view of a portion of a drum support device of the present invention mounted upon a bass drum (phantom lines) by way of a bass drum mounting fixture.

As shown in the detailed view of FIG. 5, a bass drum mounting fixture 26 is attached to, formed or incorporated on the frontal region of the device 10 to effect attachment of the first and second bar members 12, 14 to a bass drum 30. As such, the bass drum 30 actually forms a frontal support member or leg whereby the frontal portion of the device 10 is supported a fixed distance D above the underlying floor or support surface. As such, the base drum 30 acts in combination with the vertical support members 18, 20 to support the first and second rail members 12, 14 in a substantially horizontal plane, a desired distance D above the floor or support surface.

As shown in FIG. 3, the device 10 of the present invention may be formed in a plurality of segments so that the device 10 may be disassembled for easy transportation and/or storage. As shown, the arcuate first and second rail men%hers 12, 14 are separable from the centrally positioned bass drum mounting fixture 26 and the first and second vertical support members 18, 20. Also, the basal cross-member 22 is severable into three separate segments as shown. As such, the device 10 shown in FIG. 3 may be disassembled into six (6) separate sections for ease of transportation and/or storage.

Figure 4:
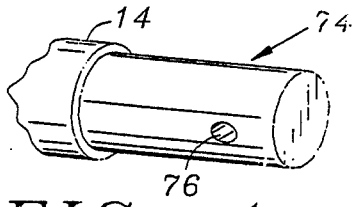
FIG. 4 is an enlarged view of a tubing connector apparatus utilized to join segments of the drum support device shown in FIG. 3.

It is preferable that the individual segments of the device can be easily assembled and disassembled. In the embodiment shown, dowel members 74 are utilized to form secure linkages between individual segments of the device 10. In accordance with FIG. 4, each dowel member 74 comprises a generally rod-shaped member inserted into and protruding from a segment of the first 14 or second 16 bar member. Apertures are formed in the adjacent tubular segments of bar members 14, 16 so as to align with the corresponding aperture 76 of each insert member 40. Screws, pins or other connector member may then be inserted through apertures 48, 50, and through the correspondingly aligned apertures of the tubular portions of device 10, so as to securely interconnect the individual segments of device 10 during assembly thereof.

One embodiment of a bass drum mounting fixture 26 of the device 10 is preferably constructed and connected in the manner shown in FIG. 5. The bass drum mounting fixture 26 comprises first and second rail member segments 12C, 14C which align with and connect to the adjacent first and second rail member segments 12A, 12B, 14A, 14B. A vertical member 52 is affixed to first and second rail segments 12C, 14C by way of angular members 54, 56. A sleeve member 58 having a hollow bore 60 is attached to the top end of vertical member 52 the hollow bore 60 of sleeve member 58 serves to receive and hold a corresponding dowel insert member affixed to one or more drums or percussion instruments to be mounted thereon.

A foot member 62 having a bottom plate 64 is connected to the bottom end of vertical member 52. A receiving track 66 is affixed to the top surface of bass drum 30. Receiving track 66 is configured relative to foot member 62 such that the bottom plate 64 of foot member 62 may be inserted into track 68 of track member 66. A set screw 70 extends downwardly through the underside of plate member 64 such that, downward tightening of set screw 71 will serve to lift and tighten plate member 64 within track 68, thereby frictionally retaining the drum connector apparatus 26 within the receiving track 66 mounted on top of the bass drum 30.

To facilitate connection of the bass drum mounting fixture 26 to the adjacent segments of the first and second rail members 12A, 12B, 14A, 14B, dowel inserts 74A, 74B may be partially inserted into and affixed to the inner bore of adjacent first and second rail member segments 12A, 12B, 14A, 14B. Apertures 76 extend through dowel segments 74. Corresponding apertures 78 are formed in the side walls of first and second tubing segments 12C, 14C of drum mounting fixture 26. Dowel member 74 may then be inserted into the hollow bores of the adjacent ends of first and second rail member segments 12C, 14C such that apertures 76 are in alignment with corresponding rail member apertures 78. Thereafter, screws 70 and nuts 72 or any other suitable fixation members may be inserted through apertures 76 and 78 to accomplish secure interconnection of the bass drum attachment fixture 26 to the remainder of the device 10.

An alternative bass drum mounting fixture 26A is shown in FIG. 5A. Referring particularly to FIG. 5A, there is shown a bass drum mounting fixture 26A. As shown in FIG. 5A, the alternative bass drum mounting fixture 26A is attached to, formed or incorporated on the frontal region of the device 10 to effect attachment of the first and second bar members 12, 14 to a bass drum 30. The alternative bass drum mounting fixture 26A comprises a vertical member 52A and affixed at the bottom end thereto a foot member 62A having a bottom plate 64A. As shown in FIG. 5, a receiving track 66 is configured relative to foot member 62A such that the bottom plate 64A of foot member 62A may be inserted into the track 68 of the track member 66.

A sleeve member 58A having a hollow bore 60A is attached to the top end of vertical member 52A and the hollow bore 60A of the sleeve member 58A serves to receive and hold a corresponding dowel insert member affixed to one or more drums or percussion instruments to be mounted thereon.

To facilitate connection of the alternative bass drum mounting fixture 26A to the adjacent segment 12A, 12B, 14A, 14B linking plates 152A and 152B are affixed to and traverse between the first bar member 12 and second bar member 14 to hold the first bar member 12 and second bar member 14 in a fixed parallel-space relation to one another, while additionally providing mounting flanges 154A and 154B. Bushings 156A, 158A ,156B, 158B are positioned with apertures formed in flange 154A and 154B, as shown. An additional aperture 157 is formed in each flange 154A, 154B to receive fixation bolts as described hereinafter. Such aforementioned bushings are positioned in the mounting flange 154 so as to be in alignment with corresponding apertures formed in the mounting plate 150.

The mounting plate 150 is affixed to the frontal portion of the vertical member 52A by a pair of gusset plates identified as 160A and 160B. The gusset plates are secured perpendicularly to the rear of the mounting plate 50 wherein the inner surface 162A and 162B of the gusset plates 160A and 160B are spaced a distance equal to the exterior diameter of the vertical member 52A. The interior surface 162A and 162B engage the exterior vertical member 52A and is connected to the vertical member 52A by conventional spot welding means or other equivalent means for affixing the same thereto.

Face plate 150 includes pins 170A and B and 172A and B. The pins are positioned within the face plate 150 so as to be in substantial alignment with the apertures of 156A, 158A, 156B, and 158B when the mounting flange 154A and B is juxtapositioned and abutted to the front of the mounting plate 150. Face plate 150 additionally includes apertures 157. Apertures 157 centered between pins 170A, 170B and 172A, 172B respectively. The apertures 157 align to receive threaded connector 1774 secured by a threaded knob-like connector 178, as shown in FIG. 5B. The alternate base drum mounting fixture 26A facilitates easy assembly and disassembly of the device 10. The face plate 150 and associated structure additionally provides mechanical load distribution from 12A and 14A to 12B to 14B and fixes the position both vertically and fore and aft by means of the face-plate 150 and pins 170A, 170B and 172A, 172B. The pins 170A, 170B and 172A, 172B, additionally are useful as a locator means thus further facilitating easy assembly.

FIG. 5B is a staggered cross-section through line 5B—5B of FIG. 5A. As indicated, the left side of FIG. 5B is sectioned through the level of bushing 158A while the right side of FIG. 5B is sectioned through the level of aperture 174B.

When the device 10 is fully assembled and mounted to a bass drum 30, as shown in FIG. 2, a plurality of individual drums, percussion instruments or other equipment (e.g., microphones) may be mounted at various locations on the first and second rail members 12, 14 by way of mounting brackets 80.

Figure 6:
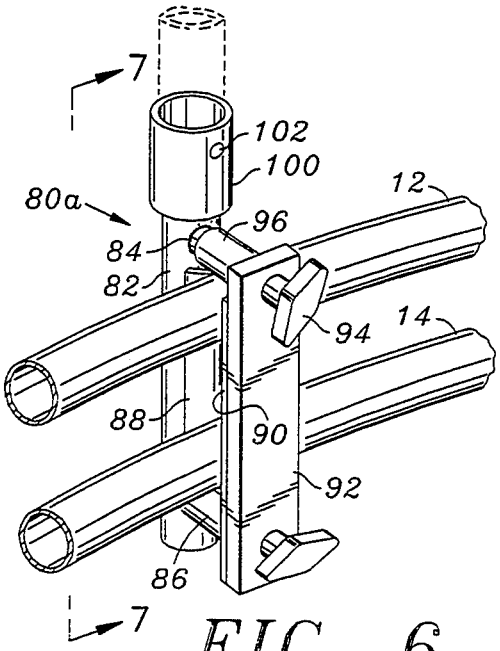
FIG. 6 is a perspective view of a first embodiment of an instrument mounting bracket whereby drums and other percussion instruments may be mounted to the drum support device of the present invention.
Figure 7:
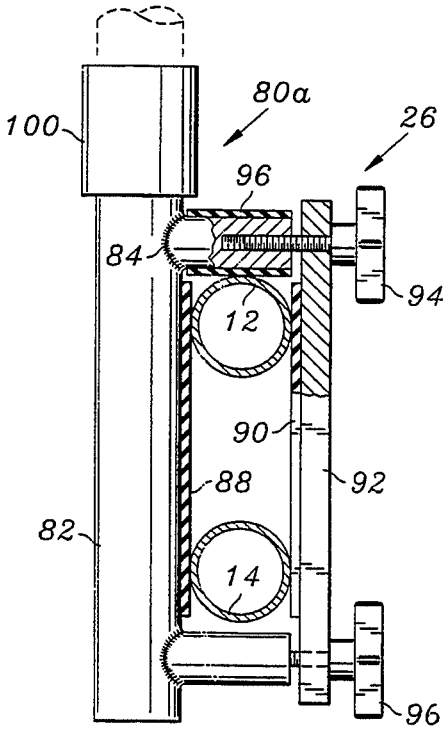
FIG. 7 is a cross-sectional view through line 7—7 of FIG. 6.
Figure 8:
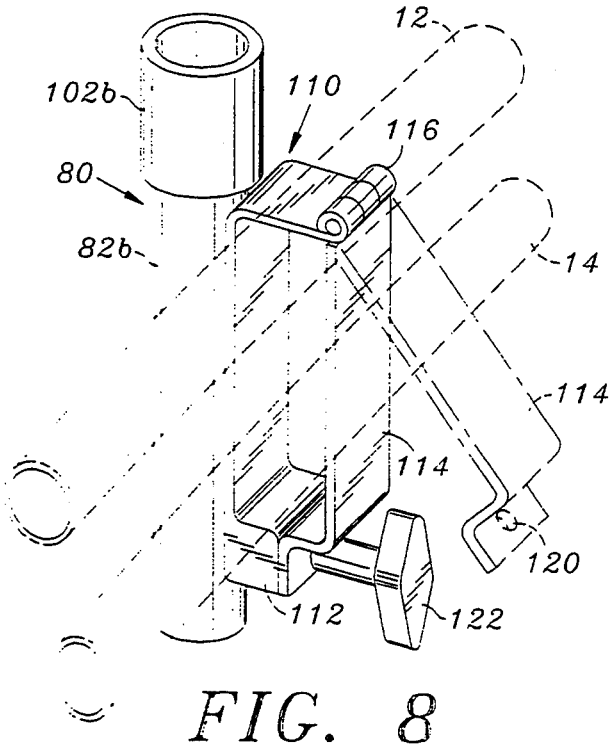
FIG. 8 is a perspective view of a second embodiment of an instrument mounting bracket whereby drums and other percussion instruments may be mounted to the drum support device of the present invention.
Figure 2A:
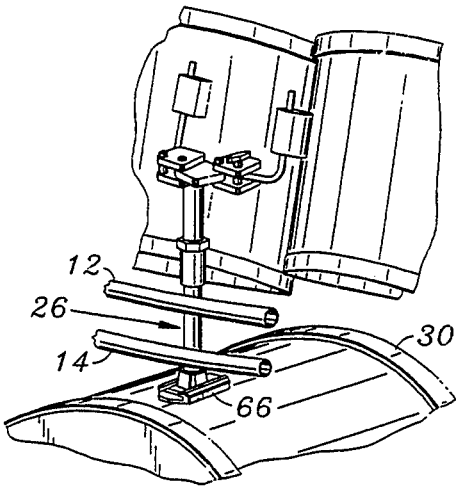
FIG. 2A is a partial front perspective view of the drum support system of the present invention shown in FIG. 2.

One embodiment of a mounting bracket 80A is shown in FIGS. 6 and 7 while an alternative embodiment of such mounting bracket 80B is shown in FIG. 8.

With reference to FIGS. 6 and 7, the first embodiment of the mounting bracket 80A comprises a vertical member 82 having first and second horizontal members 84, 86 attached to and extending perpendicular therefrom. The vertical member 82 and horizontal members 84, 86 cooperate to form a generally U-shaped structure which is slideably advanceable over both the upper rail member 12 and lower rail member 14, as shown. The length of the horizontal members 84, 86 is slightly greater than the outer diameter of the first and second rail members 12, 14.

A retainer member 92 is mountable over the outboard ends of horizontal members 84, 86 to form an enclosed region 94 within the mounting bracket 80A wherein the first and second rail members 12, 14 are retained. Threaded bores are formed within horizontal members 84, 86 to receive winged screw members 94, 96. Tightening of wing screw members 94, 96 will cause retainer member 92 to inwardly tighten against the side walls of upper and lower rail members 12, 14, thereby gripping rail members 12 and 14 between the opposing surfaces of vertical member 82 and retainer member 92.

Vibration damping pads 88, 90 formed of material such as rubber may be positioned on the opposing surfaces of vertical member 82 and retainer member 92 so as to minimize transmission of vibrational energy from the mounting bracket 80A into rail members 12, 14. Similarly, a rubber tubular sleeve 96 or other vibration-damping padding material may be formed on the surface of the upper horizontal member 84, at least in the region whereat the upper horizontal member 84 abuts against upper rail member 12, so as to minimize transmission of vibrational energy from upper horizontal member 84 into upper rail member 12.

A percussion instrument mounting fixture, such as a female sleeve member 100 is formed or positioned on vertical member 82 so as to facilitate mounting of a drum, other percussion instrument, or apparatus (e.g., a microphone) to the mounting bracket 80A. In the embodiments shown, the female sleeve member 100 is provided with a set screw receiving aperture 102. Upon insertion of a male mounting member into the inner bore of female sleeve member 100, a set screw may be inserted and tightened through set screw aperture 102, thereby holding the male mounting member (phantom lines) in connective contact with the mounting bracket 80A.

An alternative embodiment of a mounting bracket 80B is shown in FIG. 8. Such alternative embodiment mounting bracket 80B comprises a vertical member 82B having an instrument attachment apparatus, such as a female sleeve 102B positioned thereon. Such instrument connecting apparatus or female sleeve 102B may be substantially the same as that shown in the first embodiment mounting bracket 80A. A hinged clamping apparatus 110 is attached to vertical member 82B. Hinged clamping apparatus 110 is sized and configured to clamp around and hold first and second rail members 12, 14, as shown. In the preferred embodiment, the hinged clamping apparatus 110 comprises a generally U-shaped base plate 112 and a retainer member 114. Retainer member 114 is attached to the top end of the generally U-shaped base plate by way of hinge 116. The bottom end of retainer member 114 is provided with an aperture 120 through which winged screw member 122 may be inserted. A corresponding aperture (not shown) is formed in the opposing portion of base plate 112. Thus, in operation, the hinged clamping apparatus 110 may be advanced over first and second rail members 112, 114 such that rail members 112, 114 are positioned inboard of the generally U-shaped base plate 112. Thereafter, the retainer member 114 may be advanced to its closed position and winged screw member 122 may be tightened through aperture 120 to clamp and hold the mounting bracket 80B in substantially fixed position on the first and second rail members 12, 14.

Rubber pads or other vibration damping material (not shown) may be formed on the inboard surfaces of the base plate member 112 and retainer member 114 to minimize transmission of vibrational energy from the mounting bracket 80B into first rail member 12 or second rail member 14.

By engaging both upper rail member 12 and lower rail member 14, the mounting brackets 80 of the present invention will be substantially prevented from rotationally slipping even though winged screws 94, 96 or 122 may loosen slightly during operation. This is an advantage over devices which may utilize only a single rail member, as rotational movement around a single rail member is more likely in the event of loosening of the mounting bracket attached thereto.

As shown in FIG. 9, there is also provided an optional seat-frame connector apparatus 200 which functions to mount and connect the drummer's seat 202 to the basal cross member 22 of the device 10. Such interconnection between the seat 200 and the rack device 10 serves to prevent or deter movement or "walking" of the bass drum 30 and rack device 10 during operation.

In the presently preferred embodiment shown in FIG. 9, the seat-frame connector apparatus 200 comprises a basal pedestal 204 having first and second arm members 206, 208 extending rearwardly therefrom. The distal ends of arm members 206, 208 are securely fastened to basal cross member 22 by way of screws, bolts or any other suitable fastener apparatus.

As can be appreciated the apparatus shown in the invention of the present application may be utilized in association with two or more base drums. In such applications, more than one base drum mounting fixture 26 may be utilized to concommitantly attach bar members 12 and 14 to more than one bass drum.

The foregoing detailed description and the accompanying drawings are provided for purposes of describing and illustrating presently preferred embodiments of the invention only. It is appreciated that those skilled in the art will arrive at various modifications, alterations and/or additions to the herein described embodiments of the present invention. Although applicant has not endeavored to specifically describe all such modifications, alterations and/or additions, it is intended that all such modifications, alterations and additions be included within the scope of the following claims.

What is claimed is:

1. A percussion instrument support device to be used in combination with and partially supported by a base drum, said device comprising:

first and second rail members fixed in parallel relation to one another in a horizontal plane having generally coterminous first and second ends;

a first vertical support member attached to and extending downwardly from the first ends of said rail members and a second vertical support member attached to and extending downwardly from the second ends of said rail members, said first and second vertical support members defining bottom ends and being adapted to partially support said first and second rail members a fixed distance above an underlying support surface;

a mounting fixture disposed on said first and second rail members, said mounting fixture being releasably attachable to the base drum and adapted to support the first and second rail members above the base drum when attached thereto such that the mounting fixture and the base drum, in combination with said first and second vertical support members, will hold said first and second rail members in said horizontal plane at said fixed distance above the underlying support surface; and a basal cross men%her having first and second ends, the first end of said basal cross member being attached to the bottom end of said first vertical support member and said second end of said basal cross member being attached to the bottom end of said second vertical support member.

2. The device of claim 1 further comprising a first diagonal brace member attached to and traversing diagonally between said first vertical support member and said basal cross-member.

3. The device of claim 2 further comprising a second diagonal brace member attached to and traversing diagonally between said second vertical support member and said basal cross-member.

4. The device of claim 1 further in combination with a drummer's seat connected to said device.

5. The device of claim 4 wherein said drummer's seat is connected to said basal cross-member.

6. The device of claim 1 wherein said device is of segmental construction so as to be disassembled into a plurality of segments.

7. The device of claim 1 wherein said mounting fixture comprises:

a vertical member attached to and extending downwardly from said first and second rail members, said vertical member defining a bottom end;

a basal member attached to the bottom end of said vertical member; and a track member mountable on said base drum and configured to receive and virtually engage said basal member therein;

said basal member being configured relative to said track member such that said basal member may be inserted into and virtually held within said track member, thereby firmly joining and supporting said first and second rail members on top of said base drum.

8. The device of claim 1 wherein said first and second rail members are generally arcuate in configuration.

9. A percussion instrument mounting system comprising:

first and second rail members fixed in parallel relation to one another in a horizontal plane;

at least one vertical support member extending downwardly from said first and second rail members to support said first and second rail members a fixed distance above an underlying support surface; and a plurality of mounting brackets for attaching percussion instruments to said first and second rail members, each said mounting bracket comprising:

a clamping apparatus concomitantly clamping both of said first and second rail members;

means for tightening said clamping apparatus on said first and second rail members; and means for mounting a percussion instrument to said clamping apparatus such that said percussion instrument will be supported and held in a substantially fixed position by said rail members and said clamping apparatus.

10. The system of claim 9 wherein said clamping apparatus further comprises padding material between said clamping apparatus and said first and second rail members to dampen transmission of vibration therebetween.

11. The system of claim 9 wherein said clamping apparatus comprises:

a generally U-shaped mender having first and second ends, said U-shaped member being sized and configured so as to be positionable perpendicular to said first and second rail members with said first and second rail members being positioned within the U-shaped configuration thereof;

the means for tightening said clamping apparatus mountable to said U-shaped member to retain and hold said first and second rail members within said U-shaped member.

12. The system of claim 9 wherein said means for tightening said clamping apparatus is tightenable onto said U-shaped member so as to grasp said first and second rail members, thereby holding said clamping apparatus in a fixed position on said rail members.

13. The system of claim 9 wherein said first and second rail members are generally arcuate in configuration.

14. The system of claim 9 wherein said system is of segmented construction so as to be disassembled into a plurality of segments.

* * * * *